United States Patent [19]

Blanpain et al.

[11] Patent Number: 4,724,603

[45] Date of Patent: Feb. 16, 1988

[54] PROCESS FOR PRODUCING A TOROIDAL WINDING OF SMALL DIMENSIONS AND OPTIMUM GEOMETRY

[75] Inventors: Roland Blanpain, Saint Laurent du Pont; André Dumont, St Egreve, both of France

[73] Assignee: Commissariat a l'Energie Atomique, Paris, France

[21] Appl. No.: 892,786

[22] Filed: Aug. 1, 1986

[30] Foreign Application Priority Data

Aug. 13, 1985 [FR] France ..... 85 12328

[51] Int. Cl.[4] ..... H01F 41/04; H01F 41/06; H01F 41/08

[52] U.S. Cl. ..... 29/606; 336/175; 336/229

[58] Field of Search ..... 29/605, 606; 336/175, 336/207, 208, 211, 212, 229

[56] References Cited

U.S. PATENT DOCUMENTS 1,994,767 3/1935 Heintz ..... 336/229 X
3,319,207 5/1967 Davis .
3,483,497 12/1969 Clark et al. ..... 336/229 X
4,560,970 12/1985 Lenzing ..... 29/605 X

FOREIGN PATENT DOCUMENTS 0607048 6/1935 Fed. Rep. of Germany ..... 336/229

OTHER PUBLICATIONS

Abstract of Japanese Patent, vol. 8, No. 217, 4.10.1984 and JP-A-59 101 815.

Abstract of Japanese Patent, vol. 8, No. 95, 2.5.1984 and JP-A-59 14 618.

*Primary Examiner*—Howard N. Goldberg
*Assistant Examiner*—Taylor J. Ross
*Attorney, Agent, or Firm*—Cesari and McKenna

[57] ABSTRACT

This process produces a small toroidal winding used, for example, to make very stable, thin magnetic magnatometers. To produce a winding having turns which are perfectly radial with respect to a cylinder, use is made of an internal cylinder and an external cylinder provided with slots arranged along the generatrixes of these cylinders. Hairpin-shaped conductive wires are introduced into these slots and welded to one another.

2 Claims, 8 Drawing Figures

PROCESS FOR PRODUCING A TOROIDAL WINDING OF SMALL DIMENSIONS AND OPTIMUM GEOMETRY

BACKGROUND OF THE INVENTION

The present invention relates to a process for producing a toroidal winding with small dimensions and optimum geometry It is used with particular advantage in producing so-called sampling windings, which are used in magnetometers of the thin ferromagnetic film type.

Such a magnetometer is described in French Pat. No. 2 198 146. It comprises an insulating, e.g. quartz, cylinder on which is deposited a thin ferromagnetic film, which has a circumferential axis of easy magnetization. Such a means has a toroidal sampling winding wound around the cross-section of the cylinder supporting the film. FIG. 1 very diagrammatically shows the configuration of said winding. It is possible to see a hollow cylinder 10 for supporting the not shown magnetic film and a toroidal winding 12, whose turns are assumed to be in radial planes, i.e. in planes passing through the cylinder axis 13.

In view of the small dimensions thereof, in the prior art, the winding is manually wound. Therefore the orientation of the turns is not perfect. Although certain turns, such as turn 12*a* are located in a radial plane, others, such as turn 12*b*, are inclined with respect to such a plane. However, even more prejudicial defects are visible on turns 12*c* and 12*d*. Thus, in these different turns, there is, on the one hand, a direct coupling between the exciting coil and the sampling winding and, on the other hand, a misalignment between the normal to these turns and the circumferential easy magnetization axis. These two deficiencies lead to variations, errors and lack of reproducibility between individual magnetometers.

SUMMARY OF THE INVENTION

The object of the present invention is to eliminate this disadvantage by proposing a process making it possible to obtain turns which are all strictly located in radial planes.

In order to better appreciate the problem solved by the invention, it is necessary to stress that the dimensions of the torus on which the winding is to be produced are very small, the internal diameter being approximately 1 mm and the external diameter a few mm. It is for this reason that the manually performed winding necessarily leads to imperfections.

The process according to the invention is characterized in that it comprises producing a second insulating cylinder having an external diameter equal to the internal diameter of the first hollow cylinder on which the winding is to be produced, producing a third insulating cylinder having an internal diameter equal to the external diameter of the first hollow cylinder, machining on the outer surface of the second and third cylinders N slots parallel to the generatrixes of these cylinders and which are regularly spaced, producing N conductive wire hairpin-like members, each hairpin being formed from two parallel strands and a bend connecting them, said conductive wire having a sufficiently small diameter for it to be introduced into the slots made in the cylinders with an external diameter very close to the width of the slot for preventing defects of type 12*c* and 12*d*, placing the first and second insulating cylinders above one another and in accordance with the same axis, while orienting them in such a way that the N slots of one of the cylinders are aligned with the N slots of the other and with the common axis of the cylinders to form N angularly equidistant radial planes, introducing the N hairpins into the N slots arranged in this way, one strand of one hairpin being located in one slot of the second cylinder and the other strand of the same hairpin in the slot of the third cylinder located in the same radial plane, introducing the second insulating cylinder with its strands into the first hollow cylinder and passing the third cylinder, with its strands, around the first hollow cylinder and electrically connecting the ends of the strands emanating from each slot of the second cylinder, with the exception of one, to the end of the strand emanating from the slot of the third cylinder located in the adjacent radial plane, the two strands remaining unconnected forming two connections for the winding.

BRIEF DESCRIPTION OF THE DRAWINGS

The invention is described in greater detail hereinafter relative to a non-limitative embodiment and with reference to the attached drawings, wherein show.

DETAILED DESCRIPTION OF THE INVENTION

Figure 1:
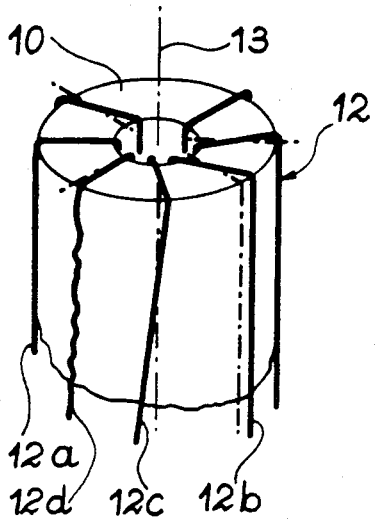
FIG. 1 PRIOR ART
FIG. 1, already described, a prior art toroidal winding.
Figure 2:
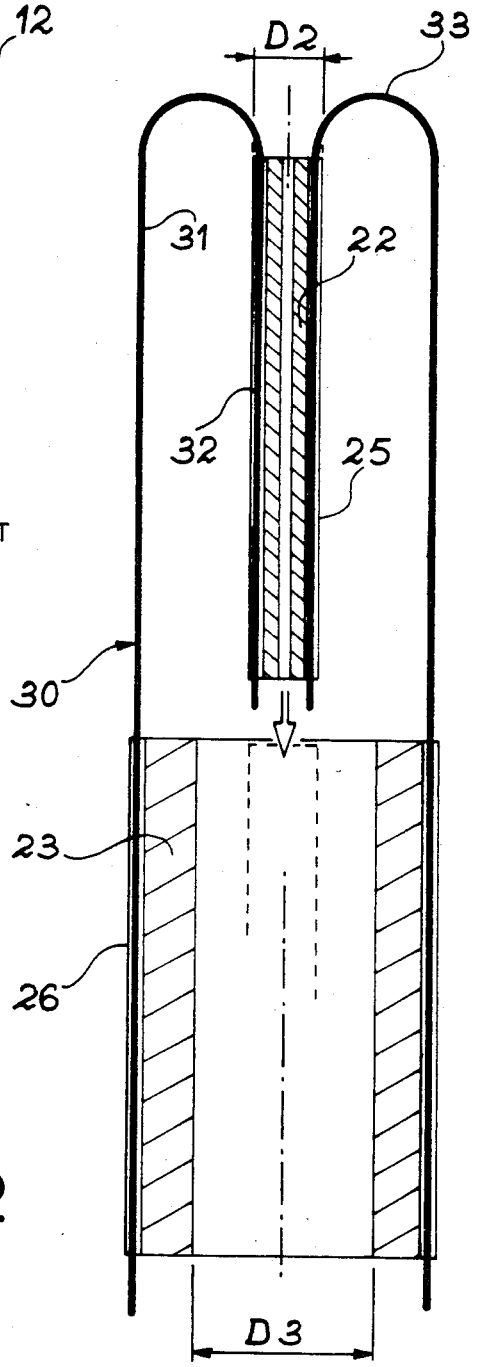
FIG. 2, an axial section of two internal and external cylinders used for fitting the conductive hairpins.
Figure 3:
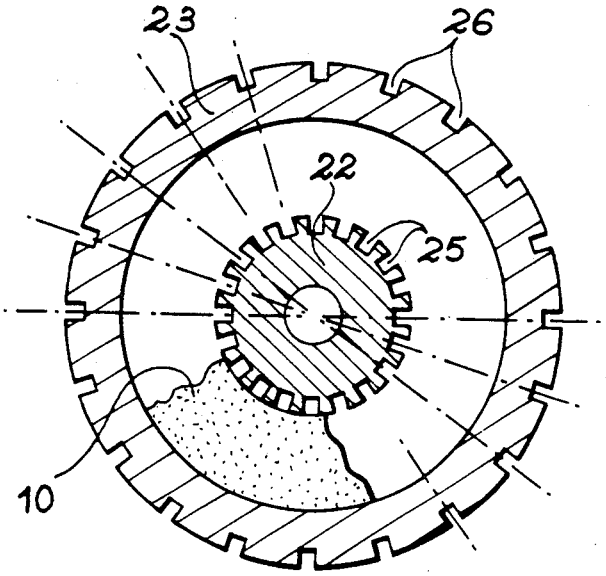
FIG. 3, an end view of the two cylinders.

FIGS. 2 and 3 show an insulating cylinder 22 with an external diameter D2 equal to the internal diameter of the hollow cylinder, on which it is wished to produce the winding and an insulating cylinder 23 having an internal diameter D3 equal to the external diameter of the hollow cylinder. For reasons linked with the structure of the magnetometer, cylinder 22 is also hollow so that, at the end of the process, it is possible to introduce into it a so-called saturation wire. On the outer surface of said cylinders are machined N slots 25 and 26 parallel to the generatrixes and spaced from one another by $$\frac{2\pi}{N}$$

(as will best be seen in FIG. 3).

The two cylinders 22, 23 are positioned one above the other in the same axis and are oriented in such a way that the N slots of one of the cylinders are aligned with the N slots of the other and with the common axis of the cylinders to form N radial planes angularly equidistant by $$\frac{2\pi}{N}$$

(as illustrated in FIG. 3).

Moreover, N conductive wire hairpin-like members 30 are produced, each hairpin being formed from two parallel strands 31, 32 and an interconnecting bend 33.

The conductive wire used has an adequately small diameter to permit its introduction into the slots 25, 26 made in cylinders 22, 23 respectively. These N hairpins are then introduced into the N slots, one strand of a hairpin being disposed in a slot of cylinder 22 and the other strand of the same hairpin in the slot of cylinder 23 located in the same radial plane.

Figure 4:
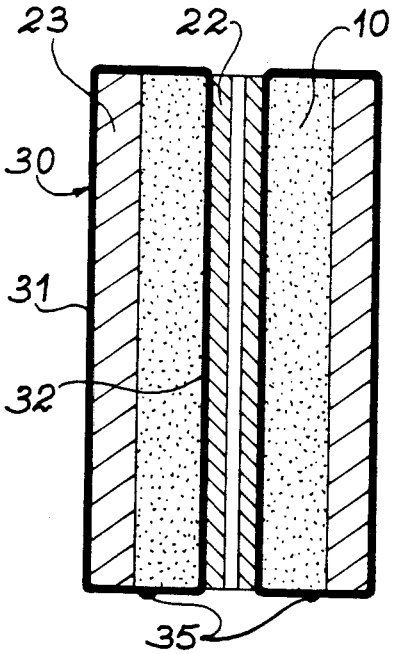
FIG. 4 in axial section, the connected assembly.

Cylinder 22 with its strands is then introduced into the cylinder 10 supporting the magnetic film and cylinder 23 with its strands is passed round hollow cylinder 10. This leads to an assembly like that illustrated in FIG. 4 with a cylinder 10, an internal cylinder 22 and an external cylinder 23. It is then merely necessary to electrically connect the ends of the different strands. For this purpose, the end of the strands emanating from each slot of the internal cylinder 22 is connected to the end of the strand emanating from the slot of the external cylinder 23 located in the adjacent radial plane.

Figure 5:
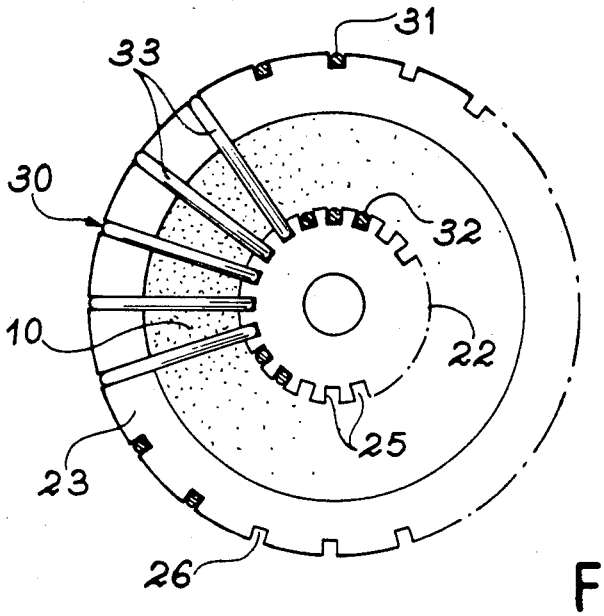
FIG. 5, the assembly in a plan view.
Figure 6:
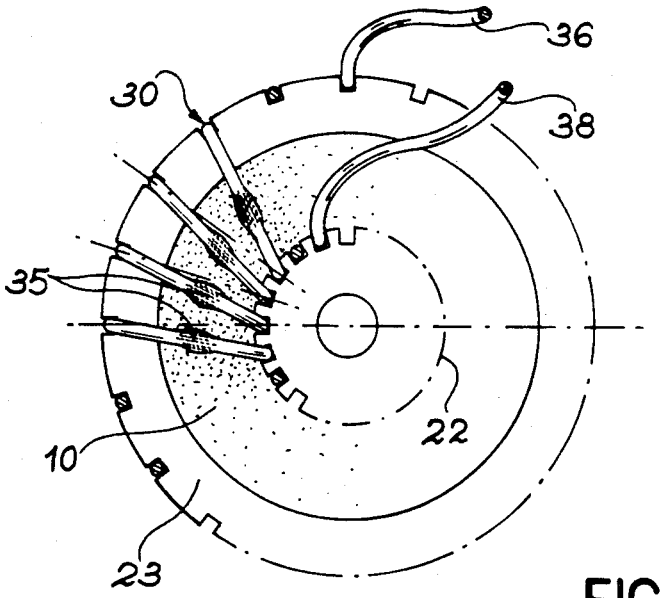
FIG. 6, the assembly in a view from below.

FIG. 5 shows the assembly in plan view, where it is possible to see the bend 33 of the hairpins, all located in radial planes. FIG. 6 shows the assembly in a view from below, where it is possible to see how the passage between adjacent turns takes place via a connecting point 35. This leads to a continuous winding, whose ends are accessible by the two strands 36, 38, which have not been interconnected.

Bearing in mind the shape of the slots guiding the conductive wire strictly in accordance with the generatrixes of the internal and external cylinders, it is clear that the turns of such a winding are precisely located in the radial planes.

Figure 7:
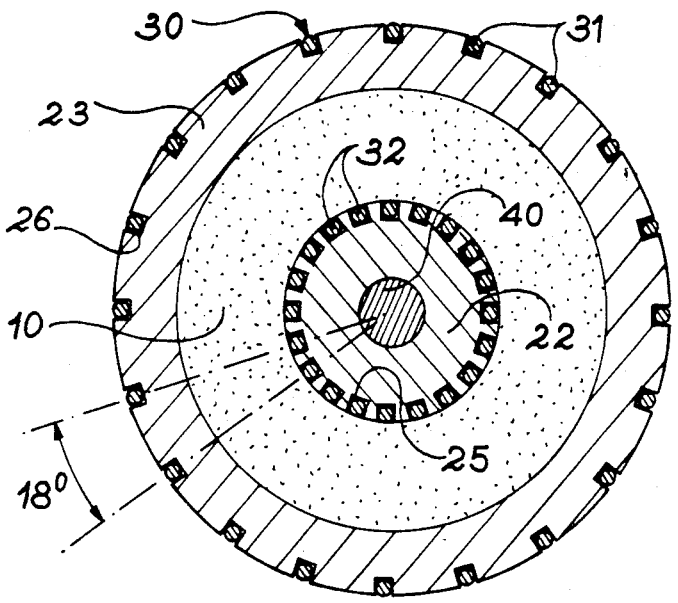
FIG. 7, a cross-section of the assembly.

FIG. 7 illustrates the final arrangement obtained at the end of the process. It is possible to see the saturation wire 40 located in the center of the internal cylinder 22.

For purely explanatory reasons, it is pointed out that the Applicant has produced a device of this type under the following conditions. The support of the thin ferromagnetic film is a quartz cylinder of external diameter 2 mm and internal diameter 1 mm. The thin film is deposited on the peripherary of said cylinder by a vacuum deposition process. These two auxiliary internal and external tubes are made from quartz or ceramics. The internal tube is a hollow cylinder with an external diameter 1 mm, having a 0.3 mm diameter channel, which is traversed by a copper wire constituting a saturation wire. The latter makes it possible on the one hand to polarize the magnetization of the film by saturating it and on the other to reinforce the anisotropy of the thin film.

The slots have a rectangular section of width 0.08 mm, which is very close to the value of the diameter of the wire forming the winding (enamel diameter included 0.075). This dimension limits to 20 the number of turns of the winding, the pitch being 18°, in order to retain an adequate quantity of material between each slot of the internal cylinder (cf. FIG. 7).

Machining to 1/100 mm minimizes the angular error between the normal to the turns of the circuit and the tangent to the easy magnetization axis of the thin film (circumferential axis) to a value of approximately $3.10^{-4}$ radian or 0.02°. Apart from the advantages already indicated, the above process has the advantage of permitting an optimization of the number of turns and of their diameter, as will now be explained.

The exciting frequency of the magnetometer is approximately 1.5 MHz. The choice of this value has resulted from a study of the minimization of the magnetometer noise. At this frequency, the skin thickness e of copper is 54 $\mu$m.

The application of Ohm's law to a cylindrical wire of diameter d makes it possible to calculate the resistance R of this wire at a frequency f, as a function of the ohmic resistance value Ro. The relation is:

$$R = Ro\frac{a^2}{2}(a - 1 + e^{-a})^{-1}$$

with $$a = \frac{d}{2e}$$

and $$Ro = K\frac{N}{d^2}$$

N being the number of turns of the circuit, K a constant, d the diameter of the wire and e the skin thickness. It is possible to write:

$$R = \frac{KN}{d^2}g(a)$$

in which g(a) is a function of a.

The optimization of the circuit consists of maximizing the thermal signal-to-noise ratio. Signal S is of form $S=\beta N^2$ (signal power in a 1 Hz band), in which $\beta$ is a coefficient; the noise B being of form B=4 kTR (noise power in a 1 Hz band), in which k is the Boltzman constant and T the temperature expressed in Kelvins. Thus, there is a signal-to-noise ratio of form:

$$\frac{S}{B} = \alpha\frac{N^2}{R}$$

in which $\alpha$ is a coefficient independent of N and R. Thus, making $$\frac{S}{B}$$

maximum amounts to making to $$\frac{R}{N^2}$$

minimum. However, N cannot be increased indefinitely, because there is a limit fixed by the fact that the product Nd is at the maximum equal to the circumference C of the internal cylinder. For Nd=C, the turns will be contiguous and for $$Nd = \frac{C}{2}$$

the situation according to FIG. 7 would be obtained with a material thickness equal to the width of one slot. For a given tube, Nd is consequently limited to a value C' (e.g. equal to $$\frac{C}{2}\Big),$$

giving: $Nd=C'$ and $$\frac{R}{N^2}=\frac{Rd^2}{C^2}$$

Thus, it is necessary to minimize the quantity $Rd^2$. However, R was calculated above:

$$R=\frac{KN}{d^2}\,g(a)$$

giving $Rd^2=KN\,g(a)$, or $$KC'\frac{g(a)}{d}$$

or $K'\,h(a)$, in which h(a) is the function $a(a-1+e^{-1})^{-1}$ and $K'$ is a constant.

Figure 8:
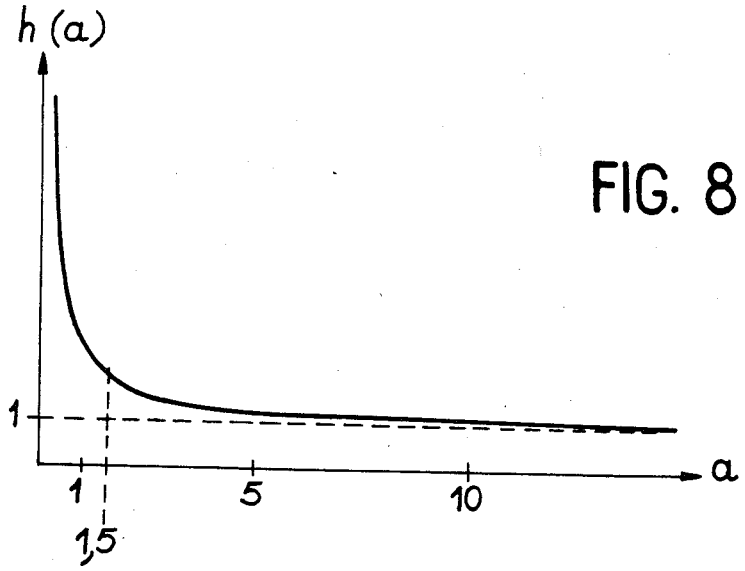
FIG. 8, a graph making it possible to determine the optimum characteristics of the winding.

FIG. 8 shows the variations of the function h(a) as a function of a. This function decreases very rapidly when a increases from 0 (decrease to $a^{-1}$ in the vicinity of 0).

When a exceeds 1 and increases, h(a) tends towards 1 and decreases very slowly. However, taking account of the diameter of the internal cylinder, a cannot reasonably exceed the value 1.5, i.e. $d_{OPT}=0.165$. The number of turns of the sampling circuit is then equal to 10.

This constraint is reasonable for producing slots. In order to retain a safety margin with regards to the mechanical behavior of the slotted tubes, it would be possible to adopt a value of d equal to $d_{OPT}/2$, i.e. approximately 0.08 mm and n=20. It should be noted that the calculation of the corresponding values of h(a) shows that the source thermal signal-to-noise ratio only decreases in a ratio of approximately $$\sqrt{3}$$

(in power). This choice is also justified by the presence of a supplementary thermal noise produced by the thermal agitation in the thin ferromagnetic film. It is 1.5 to 2 times greater than the source thermal noise for d=0.1 mm and N=20.

Naturally, it is only for explanatory reasons that the slots have been shown in the form of rectangular grooves and any other shape is suitable (cylindrical bottom, roof shape, etc.).

What is claimed is:

1. A process for producing a toroidal winding around a small hollow cylinder, said winding having to be constituted by turns strictly located in a radial plane passing through the axis of the cylinder, wherein the process comprises producing a second insulating cylinder having an external diameter equal to the external diameter of the first hollow cylinder, producing a third insulating cylinder having an internal diameter equal to the internal diameter of the first hollow cylinder machining N slots into the outer surfaces of the second and third cylinders parallel to the generatrixes of these cylinders and regularly spaced by $$\frac{2\pi}{N},$$

producing N conductive wire hairpin-shaped members, each said member being formed from two parallel strands and an interconnecting bend, the wire of said members having a diameter which is sufficiently small for it to be introduced into the slots made in the cylinders, placing the first and second insulating cylinders one above the other and along the same axis, while orienting them in such a way that the N slots of one of the cylinders are aligned with the N slots of the other cylinder and with the common axis of the cylinders to form N angularly equidistant radial planes, introducing the N members into the N thus arranged slots, a strand of one member being placed in a slot of the second cylinder and the other strand of the same member being placed in the slot of the third cylinder located in the same radial plane, introducing the second insulating cylinder with its member strands into the first hollow cylinder, passing the third cylinder with its member strands around the first hollow cylinder and electrically connecting the ends of the member strands emanating from each slot of the seocnd cylinder, except one, to the end of the member strand emanating from the slot of the third cylinder located in the adjacent radial plane, the two member strands remaining unconnected, thereby forming two connections for the winding.

2. A process according to claim 1, wherein the second cylinder is produced to be hollow and including the additional step of introducing a conductive wire into the second cylinder.

* * * * *